US006189752B1

(12) United States Patent
Perry

(10) Patent No.: US 6,189,752 B1
(45) Date of Patent: Feb. 20, 2001

(54) LADDER CARRYING DEVICE

(76) Inventor: John A. Perry, 1517 W. 14th St., Ashtabula, OH (US) 44004

( * ) Notice: Under 35 U.S.C. 154(b), the term of this patent shall be extended for 0 days.

(21) Appl. No.: 09/302,147

(22) Filed: Apr. 29, 1999

(51) Int. Cl.[7] ..... A45F 15/02

(52) U.S. Cl. ..... 224/264; 224/265; 224/270; 224/907

(58) Field of Search ..... 224/265, 266, 224/270, 907, 264; 2/459

(56) References Cited

U.S. PATENT DOCUMENTS

| | | | | |
|---|---|---|---|---|
| 2,518,107 | | 8/1950 | Wilson . | |
| 3,993,163 | | 11/1976 | Barrett . | |
| 4,022,505 | | 5/1977 | Saczawa, Jr. . | |
| 4,469,194 | | 9/1984 | McBride . | |
| 4,871,102 | * | 10/1989 | Wickersham | 224/191 |
| 4,874,120 | * | 10/1989 | Paton et al. | 224/266 |
| 5,058,789 | * | 10/1991 | Piper | 224/265 |
| 5,207,364 | * | 5/1993 | Johnson | 224/264 |
| 5,333,823 | | 8/1994 | Joseph . | |
| 5,511,285 | | 4/1996 | Bush . | |
| 5,593,145 | * | 1/1997 | Sprayberry | 269/3 |

* cited by examiner

*Primary Examiner*—Gregory M. Vidovich
*Assistant Examiner*—Maerena W. Brevard
(74) *Attorney, Agent, or Firm*—Robert R. Hussey, Co. LPA

(57) ABSTRACT

A ladder carrying device is provided for carrying a ladder either over or under the shoulder. The ladder carrying device includes the rigid frame, a cushion pad and a device for selectively attaching and detaching the frame to the ladder. The frame has a cushion connecting portion which is connected to the cushion pad and a frame attachment portion which is secured to the ladder by the attaching and detaching device. The attaching and detaching device also allows the ladder carrying device to be detached from the ladder. The frame has an extension portion extending between its frame attachment portion and cushion connecting portion to space the cushion pad a sufficient distance from the ladder so that it may be mounted in depressions in the side rails of the ladder if desired. The extension portion has outer walls and a plurality of internal ribs extending between the walls to provide a lightweight honeycomb structure while having sufficient strength to support the weight of the ladder. The connection between the cushion pad and the cushion attachment portion is provided by molding the cushion pad around surfaces that are at an angle with respect to an embedded portion of the cushion connecting portion which extend into the cushion pad.

15 Claims, 3 Drawing Sheets

LADDER CARRYING DEVICE

BACKGROUND OF THE INVENTION

This invention relates in general to a ladder carrying device for transporting a ladder and more particularly to a ladder carrying device for carrying a ladder on a persons shoulder.

Ladders are generally carried to and from storage locations or vehicles and places they are used, such as for example, construction sites. Two types of ladders are the spreading and extension designs, both of which are cumbersome and awkward to carry. Ladders generally have a pair of side rails with rungs extending between the side rails. In general, ladders are difficult to control and can swing, or rise and fall in a variety of directions and not only injure the person carrying the ladder but also persons or property in the field of movement of the ladder.

A ladder may be carried either above or below the shoulder. When the ladder is carried above the shoulder, one of the side rails are placed on the persons shoulder with the rungs and the opposing side rail above the persons shoulder. When the ladder is carried below the shoulder, one of the side rails are placed on the persons shoulder with the rungs and the opposing side rail below the persons shoulder. When a ladder is transported from one location to another, it is desirable to allow a person to transport a ladder in comfort and without injury.

In either the above or below shoulder positions, the entire weight of the ladder is exerted on the persons collar bone and muscle above it. In either ladder shoulder carrying position, there is substantial strain on the persons collar bone and muscle above it and also on the wrist since the person will try to hold ladder up to the keep the weight off himself. When a person carries a ladder in either position described above, there is substantial discomfort as a result of the ladder digging into his collar bone and muscle, straining of his wrist, and imbalance of the ladder.

In addition, ladders are difficult to balance when they are being carried. If the ladder is too far behind the person, he is constantly trying to pull the ladder down in front of him which creates a constant strain on his entire body in addition to supporting the weight of the ladder. The same balancing problem occurs when the ladder is too far ahead of the person.

It is difficult to know the best or optimum support point of the ladder and it is dependent on the person carrying the ladder and the terrain. Some believe the best support point for a ladder is at its center of balance or slightly ahead of its center of balance. At the center of balance, the person can determine whether or not the ends of a ladder are moved up or down. When the support point is in front of the center of balance of the ladder, there is some safety in that the front of the ladder will not drop and dig into the ground and possibly injure the person carrying the ladder. If the rearward end of the ladder touches the ground, it merely scrapes along as the person moves forward. Generally, the person carrying the ladder is expected to do physical work after putting the ladder in place and it is important to conserve his energy and strength.

U.S. Pat. No. 5,511,285 illustrates a known ladder carrying device and provides a handle on the side rail of the ladder. By carrying a ladder with a handle, considerable strain is exerted on the arm and back muscles. Furthermore, the ladder has to be raised when going over rough terrain or when obstacles are present in the path of movement or the ends of the ladder will hit the terrain or obstacles. By having to raise the ladder, further exertion is required by the person carrying ladder. Comment is made in this patent that an attempt has been made to provide a cushion within one of the rails of a ladder which is centrally disposed for resting of the rails against the shoulder with the arm extending between the rungs so as to facilitate carrying. Other patents show devices attached to the ends of the ladder to prevent marring of the work surface, U.S. Pat. No. 3,993,163; or restrict the ladder from slipping when in place, U.S. Pat. No. 4,469,194; or providing a shin shield for the rungs of a ladder, U.S. Pat. No. 2,518,107. A detachable device holding apparatus for step ladder is shown in U.S. Pat. No. 5,333,823 and an energy absorbing design for vehicles is shown in U.S. Pat. No. 4,022,505.

It is desirable to provide a ladder carrying device which allows a person to carry a ladder supported on his shoulder in comfort and distribute the weight of the ladder over an area of his shoulder. Since different people have different preferences as to how they carry a ladder, it is also desirable to provide a ladder carrying device which can be used to carry a ladder on persons shoulder positioned either over or under his shoulder. Likewise, it is desirable to mount the ladder carrying device in a variety of different positions on the side rails. This allows the ladder carrying device to be positioned according to the preference of the carrier.

As is known, ladders have a pair of side rails with rungs therebetween and may be of a wide variety of constructions and designs. Such known ladders may be designed with the side rails having a depression on either the inside or outside of the ladder, or the inside or outside may be flat. It is desirable to provide a ladder carrying device that may be used with ladders that both have and do not have depressions in the side rails and where the inside or outside of the side rails are flat.

It is further desirable to provide a ladder carrying device which is light in weight, decreases the possibility of injury when carrying a ladder and that is easy to manufacture.

SUMMARY OF THE PRESENT INVENTION

The ladder carrying device of the present invention is provided for carrying a ladder on the shoulder of a carrier. The present invention provides a ladder carrying device with the above described desirable features that can be implemented in a variety of ladder carrying devices.

The ladder carrying device of the present invention includes a rigid frame, a cushion pad, and a device for selectively attaching and detaching the ladder carrying device from a ladder. The rigid frame has a frame attachment portion and a cushion connecting portion. The cushion pad is formed to receive the cushion connecting portion of the frame and thereby secure the frame to the cushion pad. To achieve this connection, the cushion connecting portion of the frame has an embedded portion and an anchor portion extending at an angle from the embedded portion. The cushion pad has a recess to receive the embedded portion and anchor portion therein to secure the cushion pad to the frame. Alternatively, the anchor portion may be apertures in the embedded portion which have a surface at an angle to the embedded portion into which cushion material is formed to secure the cushion pad and frame. Yet another alternative occurs when the embedded and anchor portions are the same for example when the embedded portions are at different angles with respect to each other.

As is known, ladders have a pair of side rails with rungs therebetween and may be of a wide variety of constructions and designs. For example, extension ladders may be designed with a depression on the outside or inside of the ladders side rails. In the case where the depression is on the outside of the ladders side rails, and the carrier wishes to carry the ladder above the shoulder, the frame member is design to fit into the depression in the outside of the side rail and be attached to the side rail. The converse is true when the depression is on the inside of the ladders side rails and the carrier wishes to carry the ladder below his shoulder. Other ladders may have a flat outside and/or inside rails and the ladder caring device of the present invention is designed to also fit on the side rails of such ladders.

To accommodate the various configurations of the side rails of ladders, the frame member has an extension portion extending between its frame attachment portion and cushion connecting portion. When used with a ladder having a depression in either the inside or outside of the side rails, the extension portion extends a sufficient distance from the cushion pad so that the ladder support surface of the frame can contact the inside of the depression in the side rail with the cushion pad positioned outside of the side rail.

The extension portion of the frame is designed to be lightweight yet have sufficient strength to support the ladder on the cushion pad without buckling. The extension portion has a pair of side walls and a pair of end walls with ribs extending between the walls to strengthen the end and side walls. The ribs also extend throughout the height of the extension portion, that is between the cushion connecting portion and frame attachment portion of the frame, to provide strength throughout the height of the extension portion. Such strength is important since the weight of the ladder is exerted on the extension portion and must be sufficiently strong so as not to buckle under such loading.

Preferably, the walls and the ribs of the extension are of substantially equal thickness so that the extension portion may be easily formed by known manufacturing processes, such as injection molding. By minimizing large volumes of plastic to form the extension portion, the plastic forming the frame fills the mold and has more uniform cooling in the mold to provide a uniformly formed part without sink holes. In addition, by configuring the ribs in a honeycomb or spaced relationship, the rib construction of the present invention provides a lightweight design which decreases worker fatigue and improves manipulation of the ladder carrying device.

The ladder carrying device of the present invention also includes an attachment device for selectively attaching and detaching the frame to the ladder. The attachment device includes a ladder attachment member secured to one of the side rails of the ladder. For example, separable hook and loop fastener strips such as those sold under the trademark VELCRO may be used. One of the strips is the ladder attachment member and is attached to the side rail of the ladder. The other strip is the frame attachment member attached to the frame attachment portion of the frame. By attaching the hook and loop fastener strips together, the ladder carrying device is secured to the side rail of the ladder. Conversely, by detaching the hook and loop fastener strips from each other, the ladder carrying device is detached from the side rail of the ladder.

A number of different ladder and frame attachment members can be used both on the inside and the outside of the side rail of the ladder. In addition, they may be attached in various positions along the length of the side rail to accommodate various desired carrying positions. The extension portion of the frame allows sufficient clearance of the cushion pad from the side rails even when there is a depression in the side rails.

The ladder carrying device of the present invention may be used on ladders having side rails with or without depressions therein. In addition, the ladder carrying device of the present invention may be used for carrying the ladder either above or below the carrier's shoulder.

To provide additional comfort for the carrier, the cushion pad has a concave shoulder bearing surface which fits around the shoulder of the person carrying the ladder to more evenly distribute the weight of the ladder on his shoulder. Most ladders have their side rails adjacent each other when being carried. The cushion pad of the present invention is positioned under the particular side rail on which the frame is mounted and has an offset portion which extends over at least a portion of the other side rail. Of course, the other side rail creates some twisting in turning of the ladder since the weight of the ladder is supported by the side rail to which the frame is mounted. Such a cushion pad having an offset portion provides for more even distribution of the weight of the ladder on the carriers shoulder and also resists turning or twisting of the ladder.

DETAILED DESCRIPTION OF THE INVENTION

Figure 1:
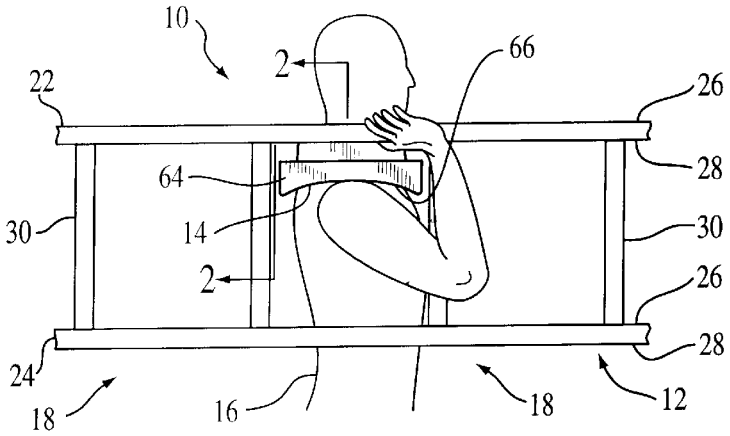
FIG. 1 shows a ladder carrying device of the present invention used by a ladder carrier when the ladder is positioned below the carriers shoulder with the arm through the ladder.

The ladder carrying device 10 of the present invention is provided for carrying a ladder 12 on the shoulder 14 of the carrier 16 in a variety of different positions. Two such positions are shown and FIGS. 1 and 3, that is the under the shoulder position 18 in FIG. 1 and the over the shoulder position 20 in FIG. 3. The present invention provides a ladder carrying device 10 that can be implemented in a variety of ladder carrying devices.

Ladders generally have a pair of side rails which either slide along each other, in the case of an extension ladder, or pivot with respect to each other, in the case of a step ladder. The opposing inner and outer sides of the side rails may be either flat or have a depression therein. The ladder carrying device 10 of the present invention may be used on ladders of a wide variety of different constructions and designs. For purposes of illustration, the ladder 12, as shown in FIGS. 1–4, has two ladder rung assemblies 22, 24 each of which have a pair of side rails 26, 28, respectively on each side of the ladder rung assemblies with rungs 30 extending between the side rails 26 and with rungs 30 extending between the side rails 28. Each of the pair of side rails 26, 28 have opposing inner 32, 34 and outer sides 36, 38, respectively.

Since the ladder illustrated in FIGS. 1–4 has identical construction on each side of the ladder rung assemblies 22 and 24, only one side of the ladder 12 will be described in connection with the use of the ladder carrying device 10 of the present invention. The side rail 26 has a depression 40 on its inner side 32 with its outer side 36 being relatively flat. The other side rail 28 has a depression 42 in its outer side 38 with its inner side 34 being relatively flat. The channel depth "d" of the depressions 40, 42 is determined by the size of the sides 44 of the side rails 26, 28. Each of the side rails 26, 28 have outermost surfaces 46, 48 respectively.

Figure 2:
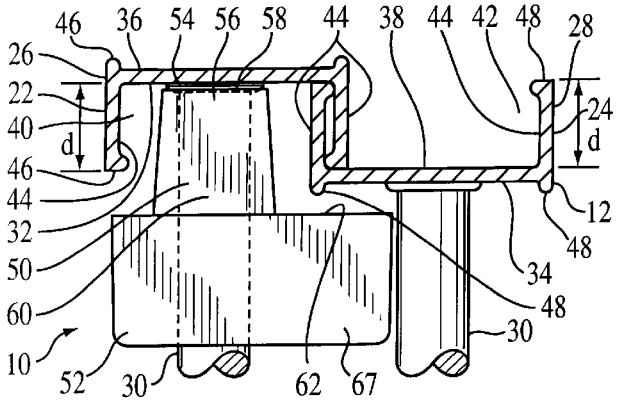
FIG. 2 is a cross-section of the portion of the ladder carrying device shown in FIG. 1 and taken along line 2—2 of FIG. 1.
Figure 3:
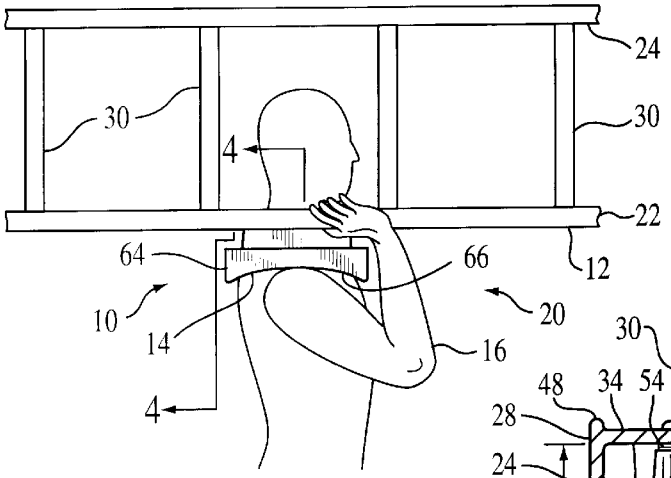
FIG. 3 shows a ladder carrying device of the present invention used by a ladder carrier when the ladder is positioned above the carriers shoulder.
Figure 4:
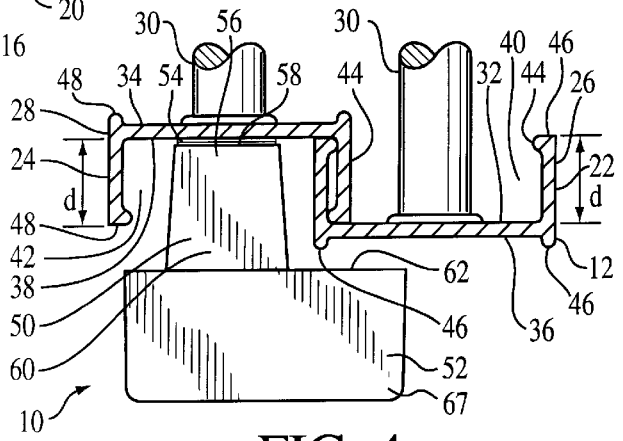
FIG. 4 is a cross-section of the portion of the ladder carrying device shown in FIG. 3 and taken along line 4—4 of FIG. 3.

The ladder carrying device 10 of the present invention may be used to carry the ladder 12 in the under the shoulder position 18, shown in FIGS. 1 and 2 or in the over the shoulder position 20 shown in FIGS. 3 and 4. The ladder carrying device 10 of the present invention includes a rigid frame 50, a cushion pad 52, and a device 54 for selectively attaching and detaching the ladder carrying device from a ladder 12.

When positioned to carry the ladder under the shoulder, as shown in FIGS. 1 and 2, the ladder carrying device 10 is positioned with the attaching and detaching device 54 mounting the ladder carrying device on the inner side 32 in the depression 40 of the side rail 26. The frame 50 has a frame attachment portion 56 having a ladder support surface 58, an extension portion 60 and a cushion connecting portion 68.

To accommodate the various configurations of the side rails of ladders, the extension portion 60 of the frame 50 extends between its frame attachment portion 56 and cushion connecting portion 68. When used with a ladder having a depression in either the inside or outside of the side rails, the extension portion 60 extends a sufficient distance from the cushion pad 52 so that the ladder support surface 58 of the frame can contact, through the attaching and detaching device 54, the inside of the depression in the side rail with the cushion pad positioned outside of the side rail.

The frame attachment portion 56 is positioned in the depression 40 and is connected to the inner side 32 of the side rail 26. The extension portion 60 extends between the frame attachment portion 56 and the cushion pad 52 to space the inner surface 62 of the cushion pad 52 from the outermost surface 48 of the side rail 28 as seen in FIG. 2. The ladder carrying device 10 is positioned between the rungs 30 so that the carriers arm can extend through the space between the rungs 30. The cushion pad 52 has a carrier support portion 64 having a concave shoulder bearing surface 66 that rests on the shoulder of the carrier when transporting the ladder.

The cushion pad 52 of the present invention is positioned under the side rail 26 on which the frame 50 is mounted and has an offset portion 67 which extends over at least a portion of the other adjacent side rail 28. The offset portion 67 resists some twisting of the ladder created by the offset of the other side rail 28 since it is spaced from the frame attachment portion 56 of the frame 50. Such a cushion pad 52 with an offset portion 67 provides for more even distribution of the weight of the ladder on the carriers shoulder and also resists turning or twisting of the ladder by the offset side rails 26, 28.

When the ladder 12 is transported to the desired location, the attaching and detaching device 54 is used to detach the ladder carrying device 10 from the ladder 12 as will be hereinafter described. Likewise, the device 54 is used to attach the ladder carrying device 10 to the ladder 12 when moving the ladder another location.

When positioned to carry the ladder 12 in the over the shoulder position 20, as shown in FIGS. 3 and 4, the ladder carrying device 10 is positioned with the attaching and detaching device 54 mounting the ladder carrying device on the outer side 38 of the side rail 28. Of course, it should be understood that the device 54 may be also used to secure the ladder carrying device 10 to the outer side 36 of the side rail 26. The frame attachment portion 56 is positioned in the depression 42 and is connected to the outer side 38 of the side rail 28. The extension portion 60 extends between the frame attachment portion 56 and the cushion pad 52 to space the inner surface 62 of the cushion pad 52 from the outermost surface 46 of the side rail 26 as seen in FIG. 4.

The ladder carrying device 10 is positioned so that the ladder 12 may be easily carried and maybe positioned in the center of balance of the ladder or forward or behind the center of balance of the ladder, dependent on the terrain and the preferences of the carrier . During transport of the ladder, the concave shoulder bearing surface 66 of the cushion pad 52 is supported by the shoulder 14 of the carrier 16 and distributes the weight of the ladder 12 over an area of the carrier's shoulder.

One embodiment of the ladder carrying device 10 of the present invention is shown in FIGS. 5–8. The ladder carrying device 10 of the present invention has a cushion pad 52, a rigid frame 50 connected on one end to a cushion pad 52 and on the other end to the device 54 for selectively attaching and detaching the ladder carrying device to and from a ladder. The frame 50 has a frame attachment portion 56 and a cushion connecting portion or cushion embedded portion 68.

Figure 6:
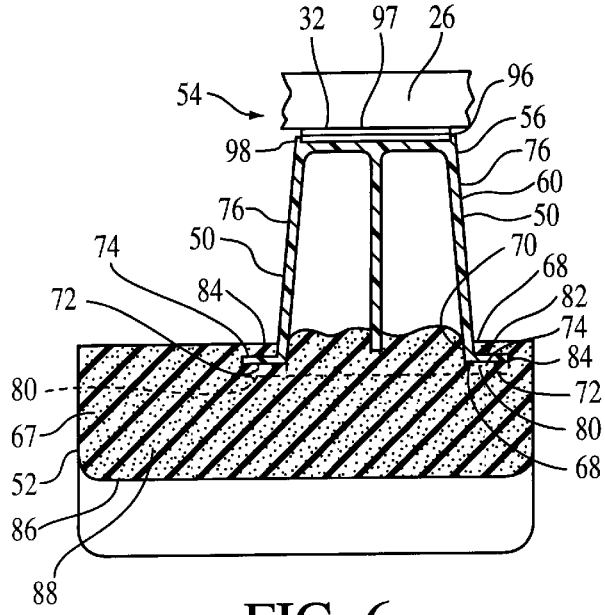
FIG. 6 is a cross-sectional view of the ladder carrying device shown in FIG. 5 and taken along line 6—6 thereof.
Figure 7:
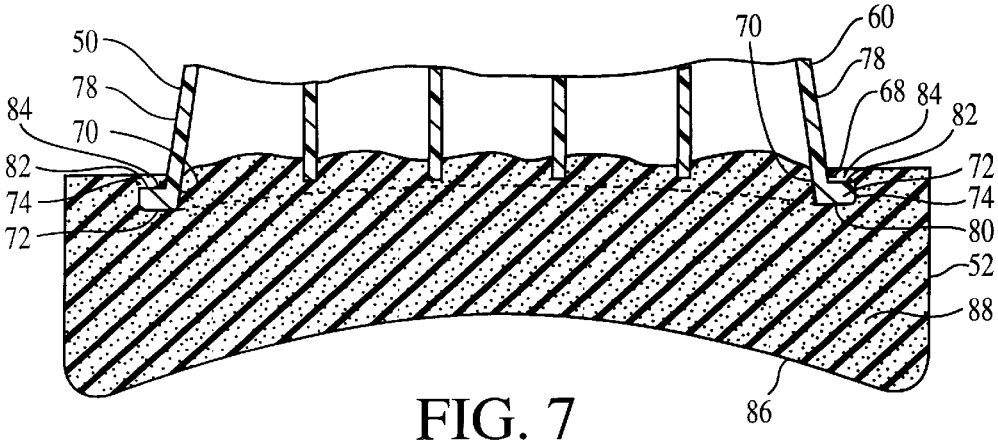
FIG. 7 is a cross-sectional view of the ladder carrying device shown in FIG. 5 and taken along line 7—7 thereof.

As seen in FIGS. 6 and 7, the cushion pad 52 is formed to receive the cushion connecting portion 68 of the frame 50 and thereby secure the frame to the cushion pad. To achieve this connection, the cushion connecting portion 68 has an embedded portion 70 with an anchor portion 72 extending at an angle from the embedded portion. The cushion pad 52 has a recess 74 to receive the embedded portion and anchor portion 70, 72 respectively therein with the cushion material in contact with the embedded portion and the anchor portion to secure the cushion pad to the frame 50.

The frame 50 has a generally rectangular shape with opposing side and end walls 76, 78 respectively. The embedded portion 70 of the cushion connecting portion 68 also has a generally rectangular cross-sectional shape and the curved bottom surface 80 defined by the bottom of the embedded portion 70 and the anchor portion 72.

The curved bottom surface 80 is particularly desirable since the curve is contoured in a similar shape to that of the concave shoulder bearing surface 66. This allows the weight of the ladder transmitted through the frame 50 to the cushion pad 52 to be more evenly distributed and transferred to the shoulder 14 of the carrier 16. The top or anchor surface 82 of the anchor portion 72 extends from and around the side and end walls 76, 78 and is flat and at an angle to the portion 70. Accordingly, the thickness of the anchor portion 72 is least at the center of the opposing side walls 76 and thicker at the end walls 78. The additional strength of the thicker anchor portion 72 at the end walls 78 increases the strength of the connection and the cushion connecting portion 68. By positioning the anchor portion 72 at an angle with respect to the embedded portion 70, a retaining portion or lip 84 of the cushion pad 52 is in contact with and formed above the anchor surface 82 of the anchor portion 72 to hold the frame 50 in the cushion pad.

To assemble the frame 50 and cushion pad 52, the frame is first formed by molding the frame 50 by any known process, such as injection molding. The frame is then placed in a cavity of a mold with the extension portion 60 positioned in the cavity and the cushion connecting portion 68 extending therefrom. The mold is then closed and the cushion pad 52 is molded around the cushion connecting portion 68 of the frame 50 to form a frame cushion assembly.

Preferably, the material from which the cushion pad 52 is made is sufficiently resilient so as to conform to the contour of the carriers shoulder 14 yet not so resilient as to be ineffectual in supporting the weight of the ladder carried. The cushion pad material preferably has an outer skin 86 surrounding the resilient core 88 so the core is protected. It has been found that one preferable material is an integral skin microcellular polyurethane foam with a core density ranging from between about 15 to 19 pounds per cubic foot with the preferred density of about 17.5 pounds per cubic foot. It is also been found that preferably the surface hardness of the skin 86 ranges in hardness (skin hardness) when measured with a Shore "a" rubber hardness gauge from between about 13 to 15 Shore "a" hardness.

Figure 8:
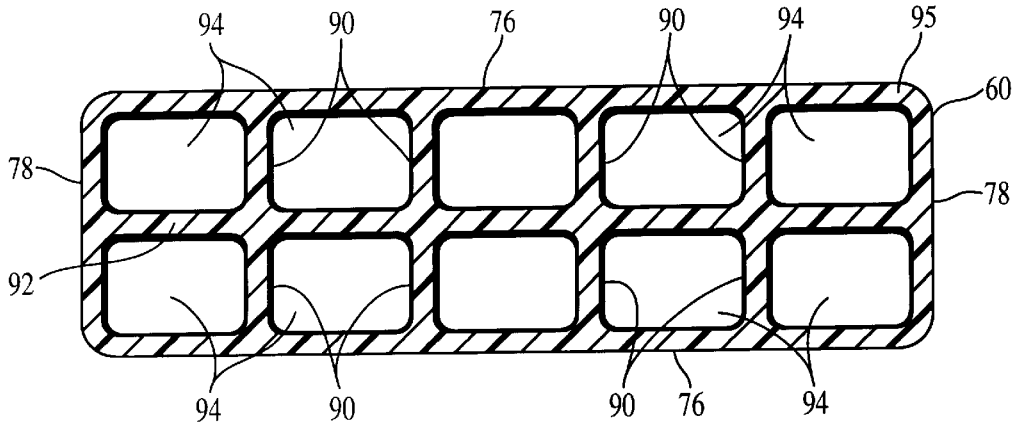
FIG. 8 is a cross-sectional view of the ladder carrying device shown in FIG. 5 and taken along line 8—8 thereof.

The frame 50 has an extension portion 60 extending between its cushion connecting portion 68 and frame attachment portion 56 as seen in FIGS. 6–8. The extension portion 60 is designed to be lightweight yet have sufficient strength and rigidity to support the weight of the ladder on the cushion pad 52 without buckling. The extension portion 60 has a pair of opposing side walls 76 and a pair of opposing end walls 78 with cross ribs 90 extending between the side walls 76 and a longitudinal rib 92 extending between the end walls 78. By so providing the cavities 94 in the extension portion 60 defined by the walls 76, 78 and ribs 90, 92, a honeycomb structure 95 is so defined and the weight of the extension portion is substantially reduced while providing sufficient strength and rigidity to support the weight of the ladder 12. The ribs 90, 92 extend between the cushion connecting portion 68 and the frame attachment portion 56 to stiffen the frame 50 throughout its height. Preferably, the walls 76, 78 and the ribs 90, 92 are of substantially equal thickness to provide uniform strength across the cross-section of the extension portion 60 and also allow the frame 50 to be easily formed by known manufacturing processes, such as injection molding. By minimizing large volumes of plastic to form the extension portion 60, the plastic forming the frame 50 fills the mold for making the frame and allows more uniform cooling of the frame in the mold which provides a uniformly formed part without sink holes. In addition, by configuring the ribs in a honeycomb 95 as shown in FIG. 8, the rib construction of the present invention provides a lightweight design which decreases worker fatigue and improves manipulation of the ladder carrying device.

Figure 5:
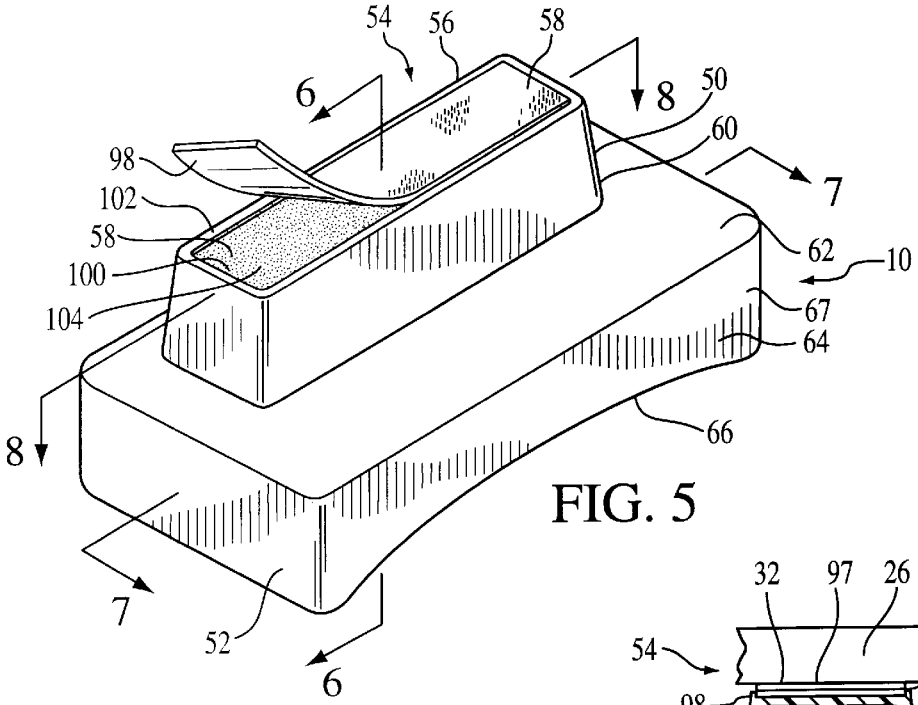
FIG. 5 is a perspective view of the ladder carrying device of the present invention.

The ladder carrying device 10 also includes an attachment device 54 for selectively attaching and detaching the ladder carrying device 10 to the ladder 12, as seen in FIGS. 5 and 6. The attachment device 54 includes a ladder attachment member 96 secured to one of the side rails 26, 28 of the ladder 12 as described above. The attachment device 54 also includes a frame attachment member 98 secured to the frame attachment portion 56 of the frame 50. The ladder attachment member 96 and the frame attachment member 98 are separable hook and loop fastener strips, such as those sold under the trademark VELCRO. It is within the contemplation of this invention that any devices that provide for the attachment and detachment of the ladder 12 and the ladder carrying device 10 may be used. As seen in FIGS. 2 and 6, the ladder attachment member 96 is attached to the inner side 32 of the side rail 26 by the means of any conventional fastening device such as adhesive 97. It should be recognized that the ladder attachment member 96 may be attached to the other sides 34, 36, 38 of the side rails 26, 28 as desired. Furthermore the ladder attachment member 96 may be positioned any place along the side rails 26, 28 as desired by the carrier.

As seen in FIGS. 5 and 6, the frame attachment member 98 is received on the ladder support surface 58 and in a recess 100. The recess 100 is formed by a lip 102 surrounding the ladder support surface 58. The frame attachment member 98 is attached to the ladder support surface 58 by means of any conventional fastening device 104, such as an adhesive. The lip 102 protects the frame attachment member 98 from being damaged, easily removed or otherwise rendered inoperative. The lip 102 is of sufficient height to protect the frame attachment member 98 yet not so great as to interfere with the interlocking of the hook and loop fastener strips 96, 98 and supporting the weight of the ladder 12 by the ladder support surface 58. By attaching the hook and loop fastener strips 96, 98 together with their respective hooks and loops engaged, the ladder carrying device 10 is secured to the side rail 28 of the ladder 12. Likewise, the ladder carrying device 10 may be detached from the side rail 28 by disengaging the loop fastener strips 96, 98.

It is within the contemplation of this invention that a wide variety of devices for selectively attaching and detaching the ladder carrying device 10 of the present invention to a ladder 12 may be used. For example, it is contemplated that one of the attachment members 96, 98 would be a plate having several key hole type openings and the other attachment member being headed pins with heads sized to fit in the enlarged portion of the key hole opening. To engage these attachment members, the heads of the pins are inserted into and positioned above the enlarged portion. They are then slid back so the shank of the pin passes through the smaller portion of the key hole opening and held in that position by the enlarged portion of the headed pin. Disengagement is effected by reversing these steps.

Figure 9:
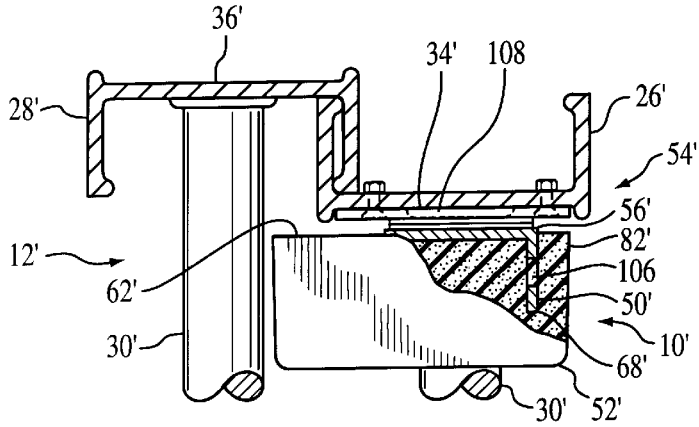
FIG. 9 is a partial cross-sectional view of another embodiment of the ladder carrying device of the present invention mounted on a ladder.
Figure 10:
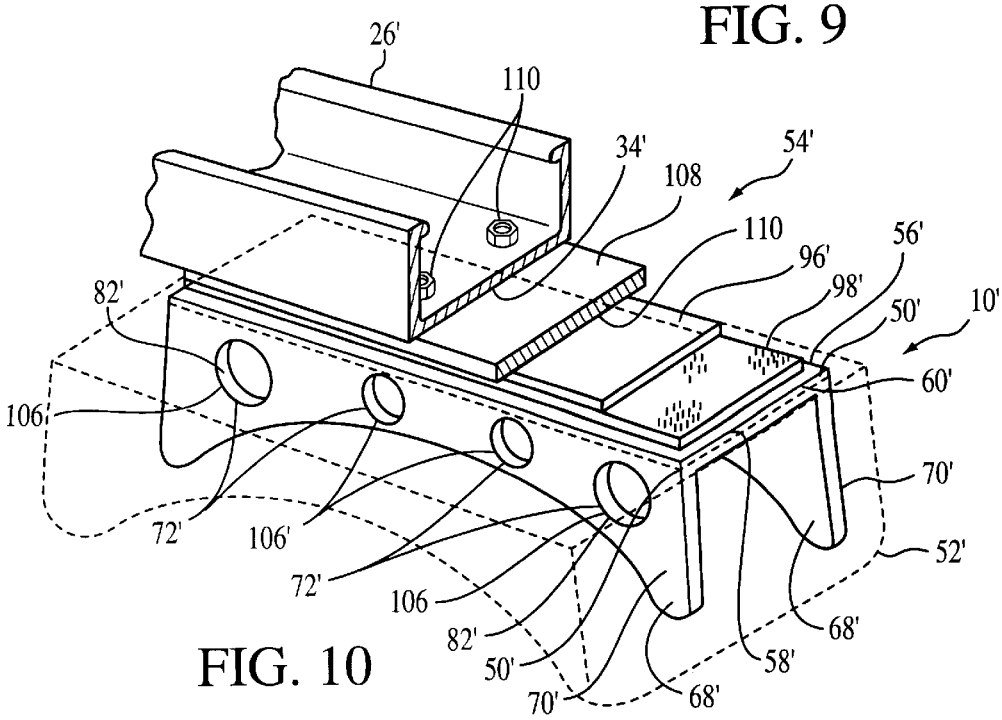
FIG. 10 is a perspective view of the ladder carrying device shown in FIG. 10 with portions of the ladder carrying device broken away and the cushion pad indicated by dashed lines.

Another embodiment of the ladder carrying device 10' of the present invention is shown in FIGS. 9 and 10 and is similar in construction with the ladder carrying device 10 described above. For ease of description, the ladder carrying device 10' is numbered with numerals the same as are used in connection with the ladder carrying device 10 to denote common parts were appropriate and followed by a prime mark "'" to denote the ladder carrying device 10'.

The ladder carrying device 10' is provided for mounting on the flat sides 34', 36' of the side rails 26', 28' of the ladder 12'. For purposes of illustration, the ladder carrying device 10' is shown as mounted on the flat surface 34' of the side rail 26' and should be understood that the ladder carrying device 10' may be mounted on the flat side 36' of the side rail 28' or any other relatively flat surface of the side rail of a ladder 12'.

The ladder carrying device 10' includes the rigid frame 50', the cushion pad 52' and a device 54' for selectively attaching and detaching the ladder carrying device to and from a ladder 12'. The frame 50' has a frame attachment portion 56', an extension portion 60' and a cushion connecting portion 68'. The cushion pad 52' is formed to receive the cushion connecting portion 68' of the frame 50' and thereby secure the frame to the cushion pad. The cushion connecting portion 68' has embedded portions 70' and anchor portions 72' formed by the apertures 106 in the embedded portions 70'. The apertures 106 provide anchor surfaces 82' which extend at an angle from the embedded portion and accordingly provide anchor surfaces or anchor portions 82' defined by the apertures 106. When the cushion pad 52' is formed around the cushion connecting portion 68', the material forming the cushion pad flows through the apertures 106 to form a retaining portion 84' in contact with the surfaces 82'. The cushion material in the apertures 106 or retaining portion 84' secures the frame 50' to the cushion pad 52' and forms a frame cushion assembly.

The ladder attaching and detaching device 54' includes a mounting plate 108 secured to the flat surface 34' of the rail 26' by any conventional fasteners, such as the threaded fasteners 110. The plate 108 has an outer surface 110 to which the ladder carrying device 10' of the present invention is mounted. It should be understood that the plate 108 is shown for illustrative purposes only, such as when a ladder carrying device is mounted on a wooden ladder. The particular ladder shown in FIGS. 9 and 10 may not need a plate 108 dependent on the specific configuration of the surface 34'.

The frame 50' is formed with its extension portion 60' positioning its ladder support surface 58' of frame attachment portion 56' away from the inner surface 62' of the cushion pad 52'. Preferably in all embodiments of the present invention, the extension portion 60, 60' is sufficient in length for the cushion pad 52, 52' to clear contact with the ladder 10, 10' but is kept to a minimum distance. The ladder attachment member 96' is secured to the plate 108 and the frame attachment member 98' is secured to the ladder support surface 58' of the frame attachment portion 56' of the frame 50'. Accordingly, the ladder carrying device 10' may be selectively attached are detached from the ladder 12' by engaging or disengaging the separable hook and loop fastener strips 96', 98'. It is within the contemplation of this invention to use other ladder attaching and detaching devices 54'.

The invention has been described with reference to the preferred embodiments. Obviously, modifications and alterations will occur to others upon reading and understanding this specification. It is my intention to include all modifications and alterations insofar as they come within the scope of the appended claims or equivalents thereof Having describes my invention, I claim:

1. A device for carrying a ladder on the shoulder of a carrier, which ladder has a pair of side rails with rungs therebetween, said ladder carrying device comprising:

a rigid frame having a cushion connecting portion and a frame attachment portion, a cushion pad connected to said cushion connecting portion of said frame and a carrier support portion for contact with the shoulder of the carrier when the ladder is carried, a device for selectively attaching and detaching said frame to the ladder including a ladder attachment member secured to said frame attachment portion of said frame and removably secured to at least one of the side rails of the ladder, said frame attachment portion has a ladder support surface, said ladder support surface spaced from said cushion pad a sufficient distance to avoid contact of the ladder with said cushion pad when said ladder carrying device is mounted on the ladder, said frame having an extension portion extending between said cushion pad and said frame attachment portion for spacing said frame attachment portion of said frame from said cushion pad, said extension portion of said frame has a plurality of outer walls and a plurality of internal ribs extending between at least two of said outer walls of said extension portion.

2. A device for carrying a ladder as described in claim 1 in which said ribs extend between said cushion connecting portion and said frame attachment portion of said frame.

3. A device for carrying a ladder on the shoulder of a carrier, which ladder has a pair of side rails with runes therebetween, said ladder carrying device comprising:

a rigid frame having a cushion connecting portion and a frame attachment portion, a cushion pad connected to said cushion connecting portion of said frame and a carrier support portion for contact with the shoulder of the carrier when the ladder is carried, said cushion pad connecting portion of said frame includes at least one anchor portion, said cushion pad having at least one retaining portion in contact with said one anchor portion to secure said frame thereto, a device for selectively attaching and detaching said frame to the ladder including a ladder attachment member secured to said frame attachment portion of said frame and removably secured to at least one of the side rails of the ladder.

4. A device for carrying a ladder as described in claim 3 wherein said cushion pad connecting portion of said frame includes an embedded portion which is embedded in said cushion pad, said one anchor portion extending at an angle from said embedded portion.

5. A device for carrying a ladder on the shoulder of a carrier, which ladder has a pair of side rails with rungs therebetween, said ladder carrying device comprising:

a rigid frame having a cushion connecting portion and a frame attachment portion, a cushion pad connected to said cushion connecting portion of said frame and a carrier support portion for contact with the shoulder of the carrier when the ladder is carried, said cushion connecting portion of said frame having at least one aperture therein, said cushion pad extending through said one aperture of said frame, a device for selectively attaching and detaching said frame to the ladder including a ladder attachment member secured to said frame attachment portion of said frame and removably secured to at least one of the side rails of the ladder.

6. A device for carrying a ladder on the shoulder of a carrier, which ladder has a pair of side rails with rungs therebetween, said ladder carrying device comprising:

a rigid frame having a cushion connecting portion and a frame attachment portion, a cushion pad connected to said cushion connecting portion of said frame and a carrier support portion for contact with the shoulder of the carrier when the ladder is carried, said cushion pad includes an offset portion extending from one side of said rigid member, a device for selectively attaching and detaching said frame to the ladder including a ladder attachment member secured to said frame attachment portion of said frame and removably secured to at least one of the side rails of the ladder said cushion pad includes an offset portion extending from one side of said rigid member.

7. A device for carrying a ladder on the shoulder of a carrier, which ladder has a pair of side rails with rungs therebetween, said ladder carrying device comprising:

a rigid frame having a cushion connecting portion and a frame attachment portion, a cushion pad connected to said cushion connecting portion of said frame, said frame having an extension portion extending between said cushion pad and said frame attachment portion, said frame attachment portion having a ladder support surface, said cushion pad connecting portion of said frame includes an embedded portion and at least one anchor surface, said cushion pad having a carrier support portion for contact with the shoulder of the carrier when the ladder is carried, said ladder support surface of said frame is spaced from said cushion pad, said embedded portion of said frame is embedded in said cushion pad, said cushion pad contacts said anchor surface of said frame to secure said frame thereto, and a device for selectively attaching and detaching said frame to the ladder.

8. A device for carrying a ladder as described in claim 7 in which said extension portion of said frame has a plurality of outer walls and a plurality of internal ribs extending between at least two of said outer walls of said extension portion.

9. A device for carrying a ladder as described in claim 8 in which said ribs extend between said cushion connecting portion and said frame attachment portion of said frame.

10. A device for carrying a ladder as described in claim 7 wherein said one anchor surface of said cushion connecting portion of said frame is defined by at least one aperture in said cushion connecting portion, said cushion pad extending through said one aperture of said frame.

11. A device for carrying a ladder as described in claim 7 wherein said cushion pad includes an offset portion extending from one side of said frame.

12. A device for carrying a ladder as described in claim 7 wherein said attaching and detaching device includes a pair of strips, one having a series of hooks thereon and the other having a series of loops thereon, one of said strips attached to said frame attachment portion of said rigid frame and the other of said strips attached to one of the side rails of the ladder.

13. A device for carrying a ladder as described in claim 7 wherein said cushion pad is formed from a material having a core density ranging from between 15 to 19 pounds per cubic foot.

14. A device for carrying a ladder as described in claim 7 wherein said cushion pad is formed from a material having a surface hardness ranging from between about 13 to 15 Shore "a" hardness.

15. A device for carrying a ladder on the shoulder of a carrier, which ladder has a pair of side rails with rungs therebetween, said ladder carrying device comprising:

a rigid frame having a cushion connecting portion and a frame attachment portion, a cushion pad connected to said cushion connecting portion of said frame and a carrier support portion for contact with the shoulder of the carrier when the ladder is carried, said cushion pad is formed from a material having a core density ranging from between 15 to 19 pounds per cubic foot and a surface hardness ranging from between about 13 to 15 Shore "a" hardness, a device for selectively attaching and detaching said frame to the ladder including a ladder attachment member secured to said frame attachment portion of said frame and removably secured to at least one of the side rails of the ladder.

* * * * *